US012545848B2

(12) United States Patent
Lee

(10) Patent No.: US 12,545,848 B2
(45) Date of Patent: Feb. 10, 2026

(54) PRETREATMENT DESULFURIZATION SYSTEM FOR REDUCING SULFUR CONTENT OF COAL BY IMMERSING COAL IN CATALYST

(71) Applicant: LOWCARBON CO., LTD, Jeollanam-do (KR)

(72) Inventor: Cheol Lee, Cheongju-si (KR)

(73) Assignee: LOWCARBON CO., LTD., Jeollanam-do (KR)

( * ) Notice: Subject to any disclaimer, the term of this patent is extended or adjusted under 35 U.S.C. 154(b) by 156 days.

(21) Appl. No.: 18/247,234

(22) PCT Filed: Jul. 5, 2021

(86) PCT No.: PCT/KR2021/008486
§ 371 (c)(1),
(2) Date: Mar. 29, 2023

(87) PCT Pub. No.: WO2022/085895
PCT Pub. Date: Apr. 28, 2022

(65) Prior Publication Data

US 2023/0365881 A1 Nov. 16, 2023

(30) Foreign Application Priority Data

Oct. 22, 2020 (KR) ..... 10-2020-0137706

(51) Int. Cl.
*C10L 10/02* (2006.01)
*C10L 9/10* (2006.01)

(52) U.S. Cl.
CPC ..... *C10L 10/02* (2013.01); *C10L 9/10* (2013.01); *C10L 2290/141* (2013.01);
(Continued)

(58) Field of Classification Search
CPC ..... C10L 5/04; C10L 9/10; C10L 9/02; C10L 10/02; C10L 2290/10; C10L 2200/0272;
(Continued)

(56) References Cited

U.S. PATENT DOCUMENTS

2002/0112567 A1* 8/2002 Kawakami ..... C21C 5/56 75/524
2019/0085255 A1* 3/2019 Lee ..... C10L 10/02

FOREIGN PATENT DOCUMENTS

JP 2001065850 A 3/2001
KR 1020010109243 A 12/2001
(Continued)

OTHER PUBLICATIONS

International Search Report for International Application No. PCT/KR2021/008486 dated Sep. 27, 2021, ISA/KR.

*Primary Examiner* — Vishal V Vasisth
(74) *Attorney, Agent, or Firm* — ArentFox Schiff LLP; Yun H. Choe

(57) ABSTRACT

Proposed is a pretreatment desulfurization system including: a first chute for supplying a pretreatment apparatus with coal transported by a belt conveyor; a pretreatment apparatus for immersing the supplied coal in a catalyst mixture obtained by mixing a desulfurization catalyst and water, thereby desulfurizing the coal; a mesh conveyor for separating the coal being immersed in the catalyst mixture and having passed through the pretreatment apparatus, into a liquid phase and a catalyst-treated coal; a mesh conveyor for transporting the catalyst-treated coal; and a storage tank for storing the transported catalyst-treated coal.

13 Claims, 7 Drawing Sheets

(52) U.S. Cl.
CPC ..... *C10L 2290/18* (2013.01); *C10L 2290/22* (2013.01); *C10L 2290/50* (2013.01); *C10L 2290/541* (2013.01); *C10L 2290/545* (2013.01); *C10L 2290/56* (2013.01)

(58) Field of Classification Search
CPC ..... C10L 2290/546; C10L 2290/18; C10L 2200/0236; C10L 2200/0222; C10L 2290/50; C10L 2290/541; C10L 2200/0218; C10L 2290/22; C10L 2290/545; C10L 2200/0209; C10L 2290/56; C10L 2200/024; C10L 2290/141; C10L 2200/0231; C10L 2200/0213; C10L 2200/0268; Y02A 50/20
See application file for complete search history.

(56) References Cited

FOREIGN PATENT DOCUMENTS

| | | | |
|---|---|---|---|
| KR | 1020050016930 | A | 2/2005 |
| KR | 100903778 | B1 | 6/2009 |
| KR | 101447334 | B1 | 10/2014 |
| KR | 101836047 | B1 | 3/2018 |
| KR | 102250538 | B1 | 5/2021 |

* cited by examiner

[FIG. 1]
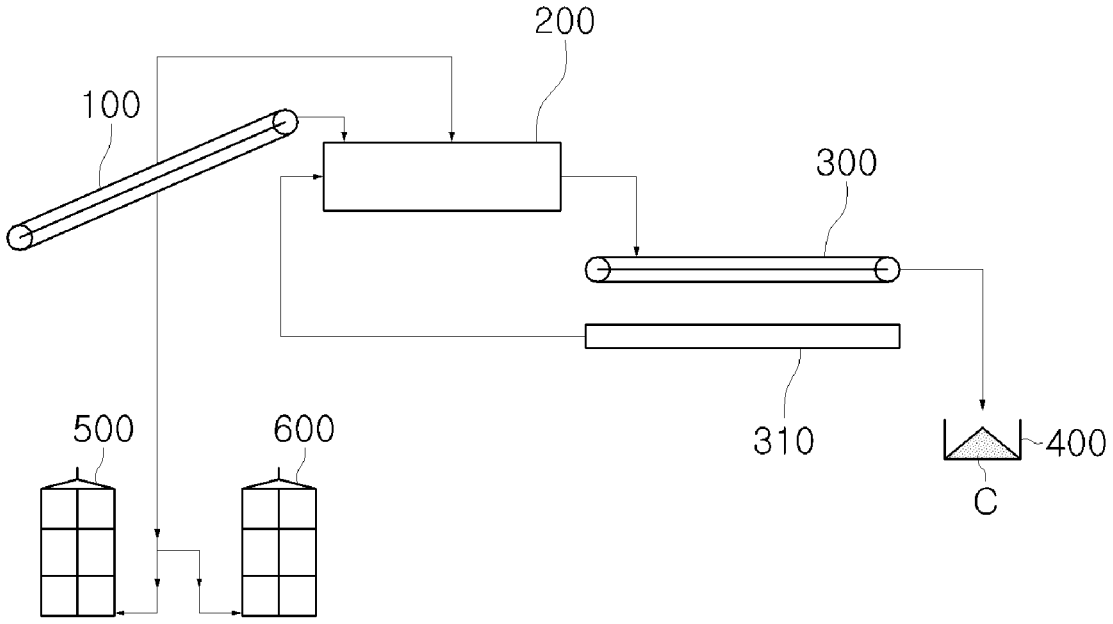

[FIG. 2]
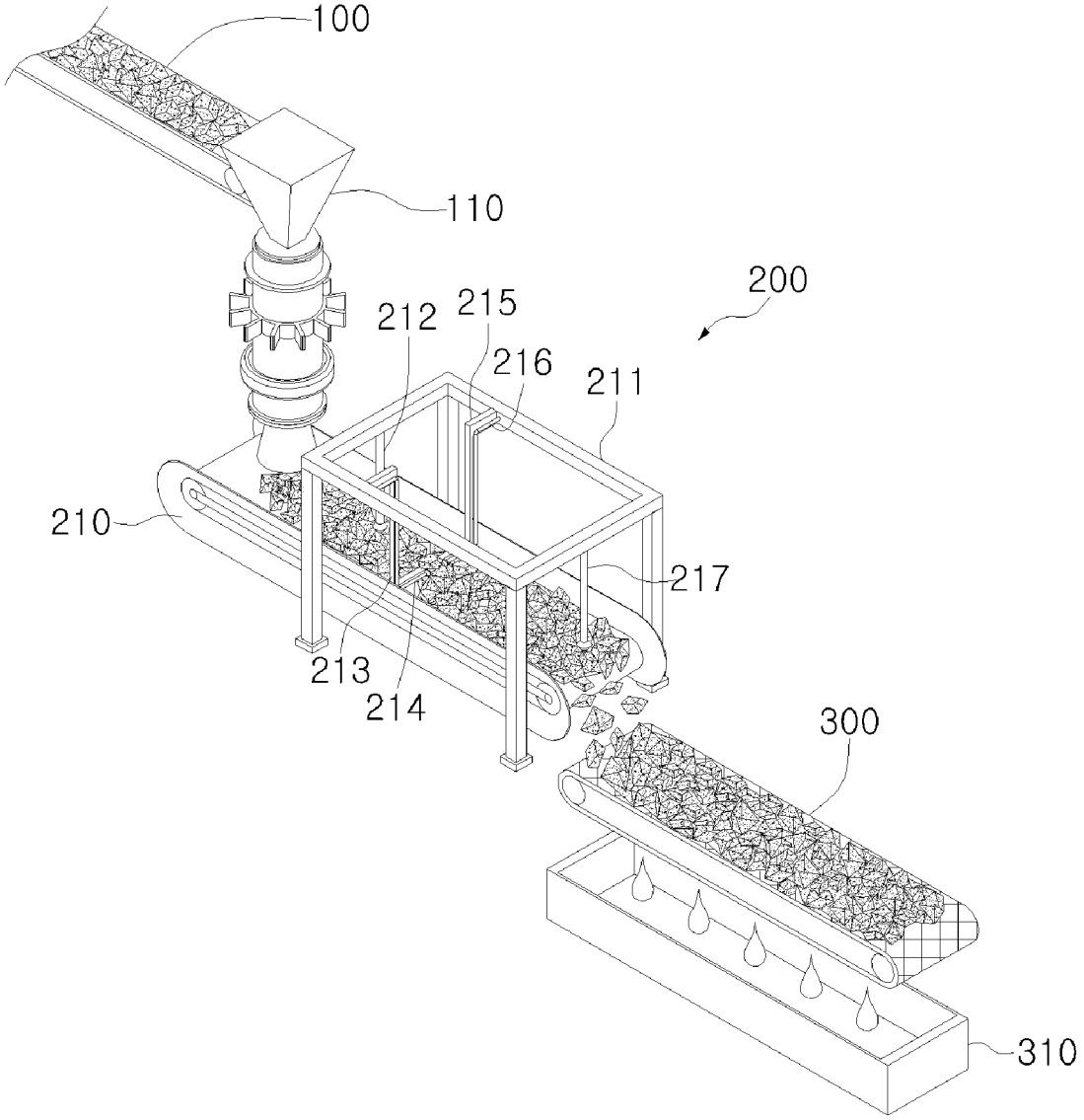

[FIG. 3]
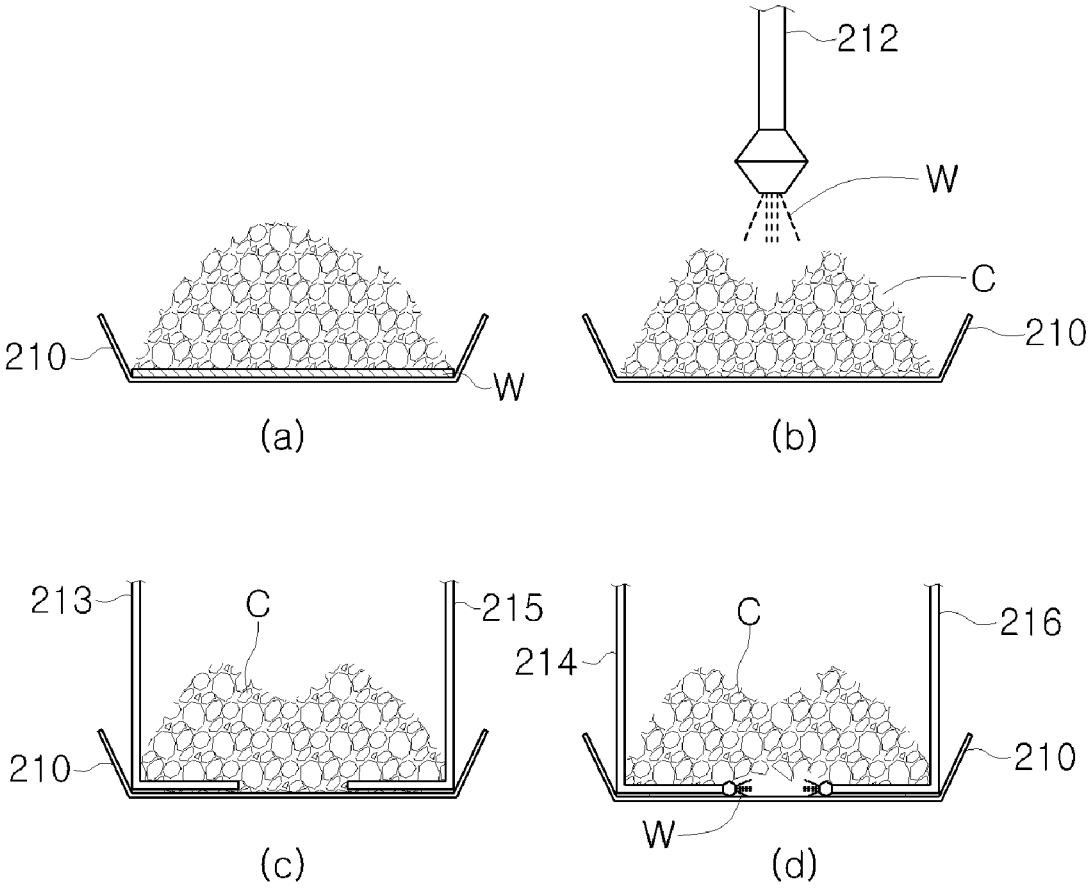

[FIG. 4]
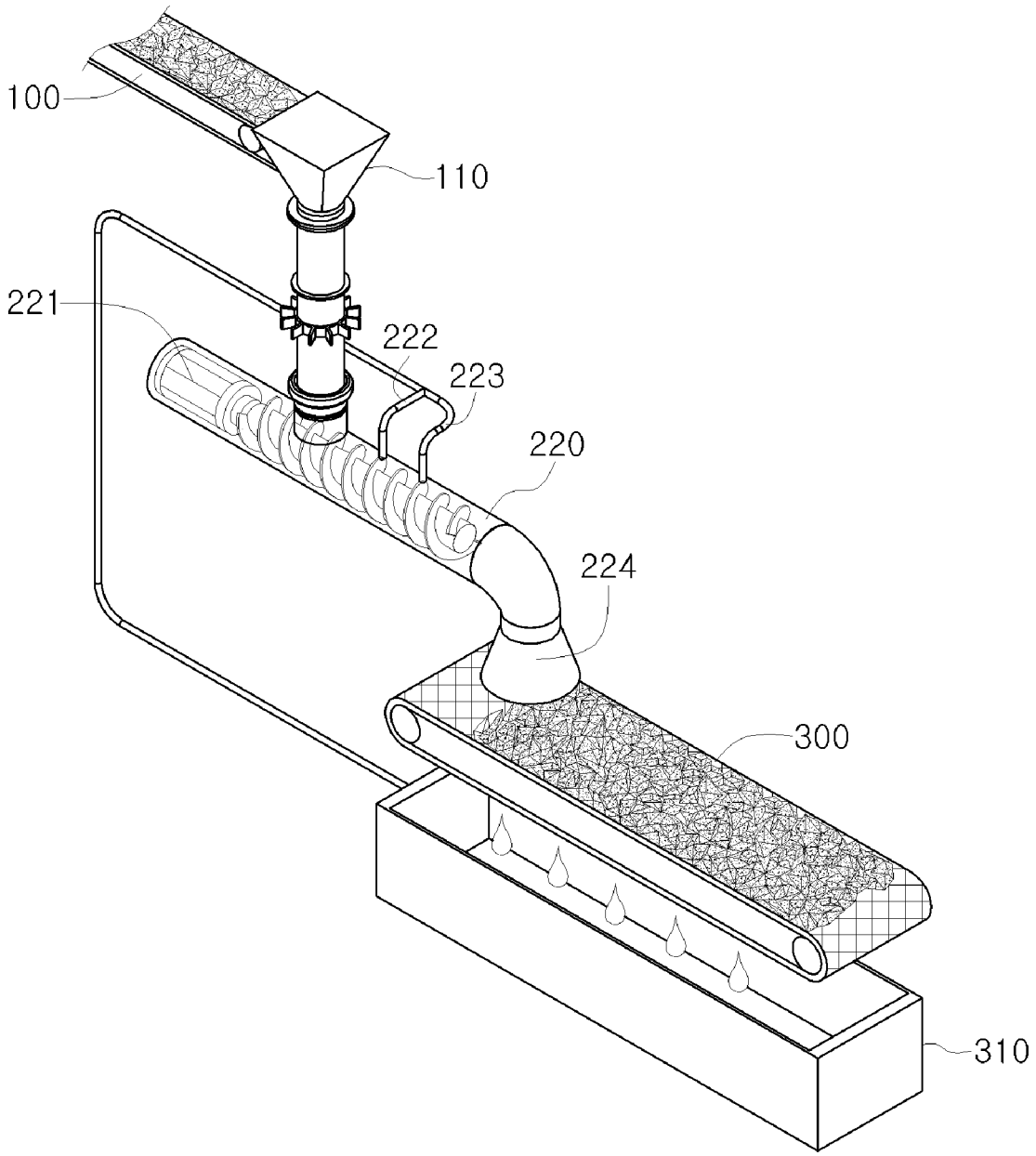

[FIG. 5]
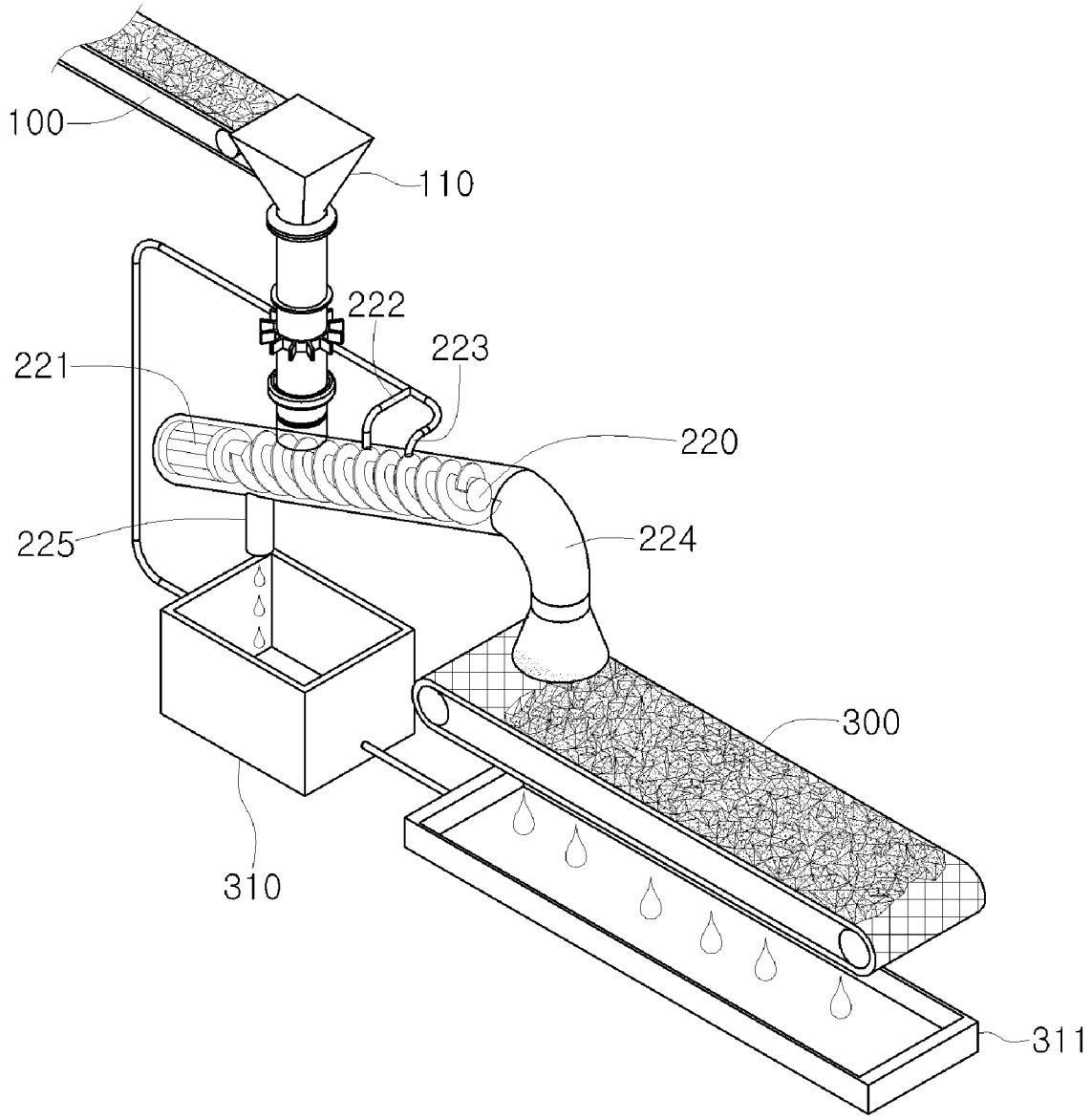

[FIG. 6]
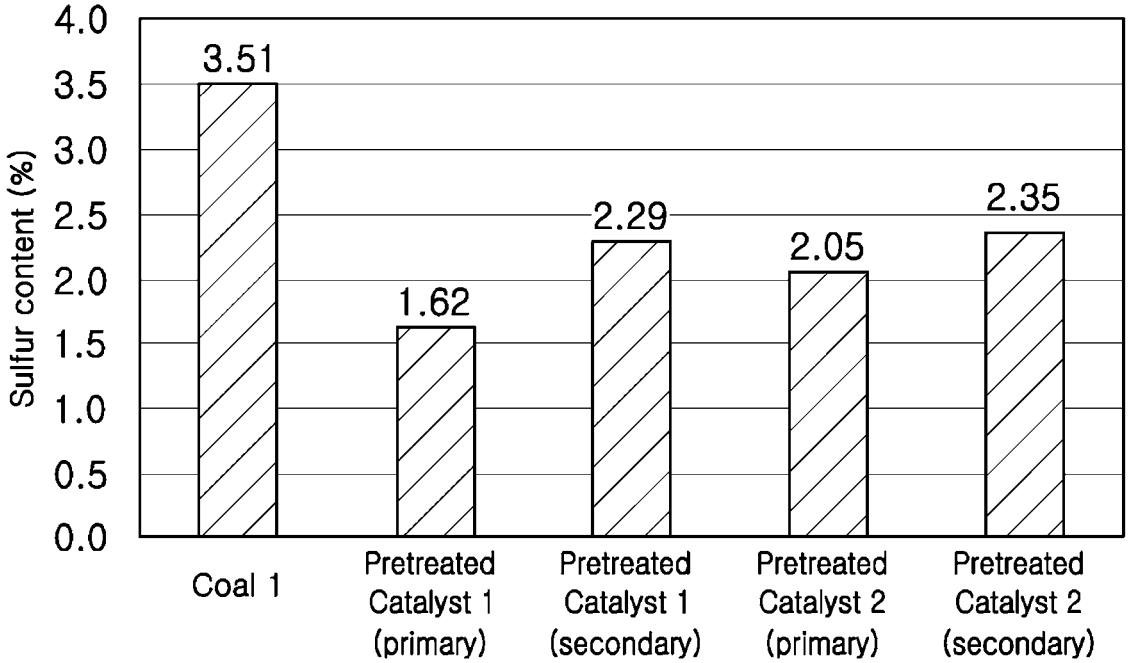

[FIG. 7]
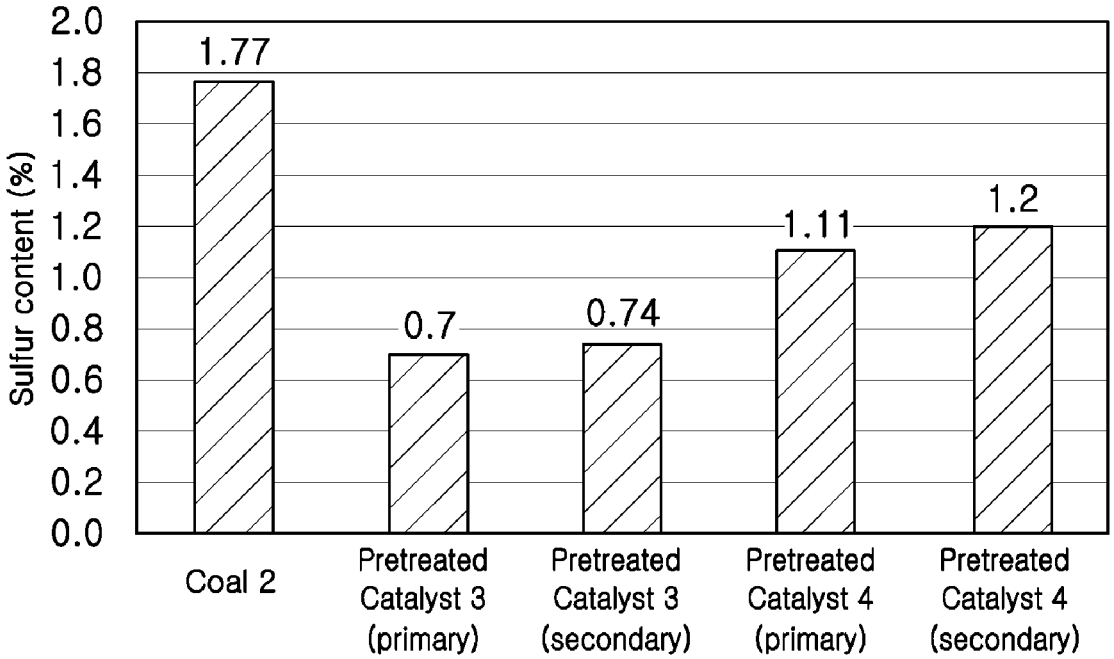

PRETREATMENT DESULFURIZATION SYSTEM FOR REDUCING SULFUR CONTENT OF COAL BY IMMERSING COAL IN CATALYST

CROSS-REFERENCE TO RELATED APPLICATION

This application is a 371 U.S. national stage of PCT/KR2021/008486, filed Jul. 5, 2021, which claims the benefit of Korean Patent Application No. 10-2020-0137706, filed Oct. 22, 2020, the contents of each of which are incorporated herein by reference.

TECHNICAL FIELD

The present disclosure relates to a pretreatment desulfurization system for reducing the sulfur content of coal by immersing coal in catalyst. More particularly, the present disclosure relates to a coal pretreatment desulfurization system for reducing emissions of sulfur oxides ($SO_x$) from coal used as a fuel during coal combustion by adsorbing sulfur oxides ($SO_x$) using a desulfurization catalyst having a desulfurization function.

BACKGROUND ART

Sulfur oxides ($SO_x$) and nitrogen oxides ($NO_x$) are pointed out as pollutants that cause air pollution. Particularly, sulfur oxides are included in industrial flue gas emitted during the combustion of fossil fuels containing sulfur, and the sulfur oxides cause various problems associated with environmental pollution, such as acid rain.

Desulfurization technology for removing sulfur oxides from industrial flue gas has been continuously studied. Conventionally, flue gas desulfurization has been used in factories or power plants using fossil fuels.

The flue gas desulfurization refers to a method of desulfurizing flue gas generated during the combustion of a fossil fuel containing sulfur gas, and the flue gas desulfurization techniques are categorized into dry processing and wet processing. The wet processing is a method of removing sulfur oxides by washing flue gas with ammonia water, sodium hydroxide solution, lime milk, or the like while the dry processing is a method of removing sulfur oxides by brining particles or powders of activated carbon or carbonates into contact with flue gas so that the activated carbon or carbonate particles adsorb or react with sulfur dioxide.

However, the existing flue gas desulfurization methods have problems in that it is necessary to construct an additional desulfurization facility to process flue gas, the operation of the desulfurization facility requires many labors and much cost, and the desulfurization process is complicated.

Therefore, in order to dramatically reduce the environmental pollution caused by the combustion of fossil fuels or by the emissions of sulfur oxides, there is an urgent need for research on an effective pretreatment desulfurization system that can significantly reduce the emissions of sulfur oxides and which is easy to use and apply.

DISCLOSURE

Technical Problem

The present disclosure has been made to solve the problems occurring in the related art, and an objective of the present disclosure is to provide a pretreatment desulfurization system for preventing emissions of sulfur oxide from coal into the air during combustion of fossil fuels such as coal by immersing coal in catalyst to reduce the sulfur content of the coal.

Technical Solution

In order to achieve the objective, one aspect of the present disclosure is to provide a pretreatment desulfurization system including: a first chute configured to supply a pretreatment apparatus with coal conveyed by a belt conveyor; the pretreatment apparatus configured to desulfurize the supplied coal by immersing the supplied coal in a catalyst mixture in which a desulfurization catalyst and water are mixed, thereby producing a catalyst-immersed coal; a mesh conveyor configured to separate the catalyst-immersed coal having passed through the pretreatment apparatus into a catalyst-treated coal and a liquid phase; and a storage tank configured to store the separated catalyst-treated coal.

Preferably, the mesh conveyor is constructed such that the liquid phase in the catalyst-immersed coal passes through the mesh conveyor and falls, and only the catalyst-treated coal remains on the mesh conveyor.

Preferably, the mesh conveyor may further include a recovery tank for collecting, storing, and re-supplying the liquid phase separated through the mesh conveyor to the pretreatment apparatus.

Preferably, the pretreatment apparatus may include: a pretreatment conveyor loaded with coal by a first chute; a frame installed above a running line of the pretreatment conveyor; a first spray nozzle supported on the frame, installed above a front end portion of the pretreatment conveyor, and configured to spray the catalyst mixture onto the pretreatment conveyor before the coal is loaded onto the pretreatment conveyer and to spray the catalyst mixture onto the coal loaded on the pretreatment conveyor; a first hook and a first hook spray nozzle that are installed over the pretreatment conveyor to serve as a unit for spraying the catalyst mixture while scraping a side surface of the coal being transported on the pretreatment conveyor, in which the first hook is spaced apart from the first spray nozzle, supported on the frame, and disposed adjacent to one side of a surface of the pretreatment conveyer, and the first hook spray nozzle is disposed on a side surface of the first hook; a second hook and a second hook spray nozzle installed to face the first hook and the first hook spray nozzle, respectively; and a second spray nozzle supported on the frame, installed above a rear end portion of the pretreatment conveyor, and configured to spray the catalyst mixture onto the coal being transported on the pretreatment conveyor.

Preferably, the pretreatment conveyor may have a U-shaped cross section so that the catalyst mixture forms a puddle on the pretreatment conveyer so that the coal is immersible in the catalyst mixture.

Preferably, the pretreatment apparatus may include: a screw conveyor to be supplied with the coal and the catalyst mixture so that the coal is immersible in the catalyst mixture; and third and fourth spray nozzles connected to an upper portion of the screw conveyor to spray the catalyst mixture.

Preferably, the catalyst mixture may be a mixture in which the desulfurization catalyst and the water are mixed in a mixing ratio in a range of 1:1 to 1:20.

Preferably, for 100 parts by weight of the coal, the desulfurization catalyst may be used in an amount of 1 to 5 parts by weight and the water may be used in an amount of 50 to 100 parts by weight.

Preferably, the desulfurization catalyst may include one or more components selected from the group consisting of: (a) one or more oxides selected from the group consisting of $SiO_2$, $Al_2O_3$, $Fe_2O_3$, $TiO_2$, MgO, MnO, CaO, $Na_2O$, $K_2O$, and $P_2O_3$; (b) one or more metals selected from the group consisting of Li, Cr, Co, Ni, Cu, Zn, Ga, Sr, Cd, and Pb; and (c) one or more liquid compositions selected from the group consisting of sodium tetraborate ($Na_2B_4O_7 \cdot 10H_2O$), sodium hydroxide (NaOH), sodium silicate ($Na_2SiO_3$) and hydrogen peroxide ($H_2O_2$).

Preferably, the oxide may include 15 to 90 parts by weight of $SiO_2$, 15 to 100 parts by weight of $Al_2O_3$, 10 to 50 parts by weight of $Fe_2O_3$, 5 to 15 parts by weight of $TiO_2$, 20 to 150 parts by weight of MgO, 10 to 20 parts by weight of MnO, 20 to 200 parts by weight of CaO, 15 to 45 parts by weight of $Na_2O$, 20 to 50 parts by weight of $K_2O$, and 5 to 20 parts by weight of $P_2O_3$, and the metal may include 0.0035 to 0.009 parts by weight of Li, 0.005 to 0.01 parts by weight of Cr, 0.001 to 0.005 parts by weight of Co, 0.006 to 0.015 parts by weight of Ni, 0.018 to 0.03 parts by weight of Cu, 0.035 to 0.05 parts by weight of Zn, 0.04 to 0.08 parts by weight of Ga, 0.02 to 0.05 parts by weight of Sr, 0.002 to 0.01 parts by weight of Cd, and 0.003 to 0.005 parts by weight of Pb.

Preferably, the oxide and metal have a particle size of 1 to 2 lam and a specific gravity of 2.5 to 3.0.

Preferably, the liquid composition may include sodium tetraborate ($Na_2B_4O_7 \cdot 10H_2O$) in an amount of 20 to 130 parts by weight, sodium hydroxide (NaOH) in an amount of 15 to 120 parts by weight, sodium silicate ($Na_2SiO_3$) in an amount of 50 to 250 parts by weight, and hydrogen peroxide ($H_2O_2$) in an amount of 10 to 50 parts by weight.

Preferably, in the desulfurization catalyst, the oxide, the metal, and the liquid composition may form a metal chelate compound.

Advantageous Effects

The coal pretreatment desulfurization system using a desulfurization catalyst, according to the present disclosure, can prevent emissions of sulfur oxides into the air during coal combustion, thereby contributing to solving the problems of air pollution caused by sulfur oxides.

In addition, unlike conventional flue gas desulfurization methods of performing desulfurization after the completion of fuel combustion, the pretreatment desulfurization system according to the present disclosure pretreats coal with a pretreatment desulfurization catalyst by immersing the coal in the pretreatment desulfurization catalyst, thereby allowing the coal and the desulfurization catalyst to be combusted together. Therefore, the coal pretreatment desulfurization system according to the present disclosure can be implemented using an existing combustion system without building a new additional facility for desulfurization. That is, the coal pretreatment desulfurization system according to the present disclosure is simple and easy to apply and exhibits good desulfurization efficiency.

In addition, the pretreatment desulfurization system according to the present disclosure recovers the pretreatment desulfurization catalyst from the waste liquid generated by the coal pretreatment process. Since, the desulfurization catalyst is recycled, the pretreatment desulfurization system according to the present disclosure is economically and environmentally beneficial.

BRIEF DESCRIPTIONS OF DRAWINGS

FIG. 1 is a view illustrating the construction of a pretreatment desulfurization system according to the present disclosure;

FIG. 2 is a view illustrating the construction of a pretreatment apparatus of the pretreatment desulfurization system according to the present disclosure; and FIG. 3 is a view illustrating a coal pretreatment process performed by the pretreatment apparatus of FIG. 2.

FIG. 4 is a view illustrating the construction of a pretreatment apparatus of the pretreatment desulfurization system according to the present disclosure; and FIG. 5 is a view illustrating another example of the pretreatment apparatus illustrated as in FIG. 4.

FIG. 6 is a view illustrating the mean value of the total sulfur content of each of Coal 1, Pretreated Coal 1, and Pretreated Coal 2.

FIG. 7 is a view illustrating the mean value of the total sulfur content of each of Coal 2, Pretreated Coal 3, and Pretreated Coal 4.

BEST MODE

The present disclosure may be embodied in many forms and have various embodiments. Thus, specific embodiments will be illustrated in the accompanying drawings and described in detail below.

While specific embodiments of the invention will be described herein below, they are only illustrative purposes and should not be construed as limiting to the present disclosure. Accordingly, the present disclosure should be construed to cover not only the specific embodiments but also cover all modifications, equivalents, and substitutions that fall within the sprit and technical scope of the present disclosure.

It will be further understood that the terms "comprises", "includes", or "has" when used in this specification specify the presence of stated features, regions, integers, steps, operations, elements and/or components, but do not preclude the presence or addition of one or more other features, regions, integers, steps, operations, elements, components and/or combinations thereof.

Hereinafter, embodiments of the present disclosure will be described in detail.

The present disclosure relates to a pretreatment desulfurization system for reducing the sulfur content of coal by immersing the coal in catalyst. More particularly, the present disclosure relates to a coal pretreatment desulfurization system for absorbing and reducing sulfur oxides ($SO_x$) during coal combustion by using a desulfurization catalyst having a desulfurization function, thereby reducing emissions of sulfur oxides ($SO_x$) from coal used as a fuel.

In addition, the present disclosure can be used in coal mining and the like. The present disclosure can be applied to high-sulfur coal or a mixture of high-sulfur coal and low-sulfur coal.

Specifically, the present disclosure provides a pretreatment desulfurization system including: a first chute configured to supply coal conveyed by a belt conveyor to a pretreatment apparatus; the pretreatment apparatus configured to desulfurize the coal by immersing the supplied coal in a catalyst mixture composed of a desulfurization catalyst and water, thereby producing a catalyst-immersed coal which refers to the coal immersed in the catalyst mixture; a mesh conveyor configured to separate the catalyst-immersed coal having passed through the pretreatment apparatus into a liquid phase and a catalyst-treated coal; and a storage tank configured to store the separated catalyst-treated coal.

Unlike conventional flue gas desulfurization methods of performing desulfurization after the completion of fuel combustion, the pretreatment desulfurization system according to the present disclosure pretreats coal with a pretreatment desulfurization catalyst by immersing the coal in the pretreatment desulfurization catalyst, thereby allowing the coal and the pretreatment desulfurization catalyst to be combusted together. Therefore, the coal pretreatment desulfurization system according to the present disclosure can be implemented using an existing combustion system without building a new additional facility for desulfurization. That is, the coal pretreatment desulfurization system according to the present disclosure is simple and easy to apply and exhibits good desulfurization efficiency.

Hereinafter, a pretreatment desulfurization system 10 according to the present disclosure will be described in more detail with reference to the drawings illustrating embodiments of the present disclosure.

FIG. 1 is a schematic view illustrating the overall construction of a pretreatment desulfurization system according to the present disclosure.

Referring to FIG. 1, the pretreatment desulfurization system 10 according to the present disclosure includes: a belt conveyor 100 for transferring coal; a first chute 110 for supplying coal from the belt conveyor 100 to a pretreatment apparatus 200; the pretreatment apparatus 200 for desulfurizing the supplied coal by immersing the coal supplied by the first chute 100 in a catalyst mixture in which a desulfurization catalyst and water are mixed, thereby producing a catalyst-immersed coal which refers to the coal immersed in the catalyst mixture; a mesh conveyor 300 for separating the catalyst-immersed coal having passed through the pretreatment apparatus 200 into a catalyst-treated coal and a liquid phase; and a storage tank 400 for storing the separated catalyst-treated coal.

The coal is transported by the belt conveyor 100 and is supplied to the pretreatment apparatus via the first chute 110. Therefore, it is possible to minimize the generation of dust or particulate matter that may occur when the coal falls directly from the belt conveyor 100 to the pretreatment apparatus.

The coal supplied from the first chute 110 is immersed in a catalyst mixture in which a desulfurization catalyst and water are mixed in the pretreatment apparatus, so that a catalyst-treated coal is obtained. Herein, the catalyst-treated coal refers to coal impregnated with the pretreatment desulfurization catalyst.

In the pretreatment apparatus 200, the coal and the catalyst mixture are mixed. In this case, the desulfurization catalyst is introduced into coal in bulk. In the case of the immersion method, the desulfurization catalyst can deeply infiltrate into the coal as compared to conventional catalyst treatment methods in which catalyst is sprayed onto the surface of coal or is mixed with coal using a screw conveyor. When the coal desulfurization is performed by immersing coal in a desulfurization catalyst, since the desulfurization catalyst is present inside the coal, sulfur oxides can be more easily removed during coal combustion.

The pretreatment apparatus 200 further includes one or more spray nozzles for supplying a desulfurization catalyst and water. For the supply of the desulfurization catalyst and water, only a single spray nozzle may be used. In this case, the desulfurization catalyst and water are supplied together. Alternatively, two or more spray nozzles may be used to separately supply the desulfurization catalyst and water.

The pretreatment desulfurization system according to the present disclosure may further include a desulfurization catalyst tank 500 for storing the desulfurization catalyst and a water tank 600 for storing the water.

The desulfurization catalyst is stored in the desulfurization catalyst tank 500 and then transported to the pretreatment apparatus 200 by using a flow meter and a pump. The water is stored in the water tank 600 and then transported to the pretreatment apparatus 200 by using a flow meter and a pump. In this case, the spray nozzle of the pretreatment apparatus 200 is connected to the desulfurization catalyst tank 500 and to the water tank 600 so that the desulfurization catalyst and the water can be supplied to the pretreatment apparatus through the spray nozzle.

The catalyst-immersed coal having passed through the pretreatment apparatus 200 is transferred to the mesh conveyor 300 to be separated into a liquid phase and a catalyst-treated coal. Since the catalyst-immersed coal is separated into the liquid phase and the catalyst-treated coal, the residual catalyst remaining in the liquid phase after the separation can be recovered and reused. In addition, when the catalyst-immersed coal is not separated into the liquid phase and the catalyst-treated coal, the residual catalyst may permeate into the pores of coal or accumulate on the surface of the transfer conveyor, and thus the particulate matter of the coal may become sludge. Therefore, the separation is performed to prevent such a problem.

The mesh conveyor 300 is a conveyor belt made of a mesh material, so that the mesh conveyer 300 can filter out a solid phase and allow a liquid to pass through.

The mesh conveyor 300 is configured such that the liquid phase of the catalyst-immersed coal can fall through the mesh conveyor 300, and only the catalyst-treated coal remains on the mesh conveyor 300.

The mesh size of the mesh conveyor 300 may be in the range of from 100 to 250.

The pretreatment desulfurization system may further include a recovery tank 310 for collecting and storing the liquid phase separated through the mesh conveyor 300 and for re-supplying the collected liquid phase to the pretreatment apparatus 200.

The liquid phase collected in the recovery tank 310 is actually a dispersion in which the coal and the catalyst are dispersed in liquid, and this liquid phase is supplied to a filter presser (not illustrated) to be described later using a pump (not illustrated).

The pretreatment desulfurization system 10 according to the present disclosure may further include the filter presser (not illustrated). The filter presser receives the liquid phase transported from the recovery tank 301 by a pump liquid and filters out the residual coal contained in the liquid phase.

The filter presser includes a filter. When the liquid phase is introduced into the filter presser and applied with pressure, solids in the liquid phase are filtered out as a filter cake, and fluid (i.e., filtrate) passes through the filter.

The filter cake generated by the filter presser is discharged from the filter presser and transferred to the storage tank 400. This discharged filter cake is a catalyst-treated coal C.

The desulfurization catalyst and the water passing through the filter are recovered and transported to the recovery tank 310. The recovered desulfurization catalyst and the water may be stored in the recovery tank 310 and then re-supplied to the pretreatment apparatus 200 by a pump and a flow meter.

The pretreatment desulfurization system 10 according to the present disclosure collects the liquid phase discharged after the coal pretreatment, using the recovery tank 310. Therefore, it is possible to recover the desulfurization catalyst from the collected liquid phase and recycle the desulfurization catalyst. Therefore, the system of the present disclosure is economically and environmentally beneficial.

The catalyst-treated coal C separated by the mesh conveyor 300 is stored in the storage tank 400 until the entire moisture contained in the catalyst-treated coal is removed. To this end, a hot air heater or a heating device may be provided inside or outside the storage tank 400.

Preferably, the catalyst mixture may be a mixture in which the desulfurization catalyst and the water are mixed in a mixing ratio range of 1:1 to 1:40. For example, in the catalyst mixture, the desulfurization catalyst and the water may be mixed in a mixing ratio in the range of from 1:1 to 1:35, from 1:1 to 1:20, from 1:1 to 1:15, from 1:1 to 1:10, from 1:1 to 1:5, from 1:3 to 1:40, from 1:5 to 1:40, from 1:10 to 1:40, or from 1:20 to 1:40.

For 100 parts by weight of the coal supplied to the pretreatment apparatus 200, the desulfurization catalyst may be supplied in an amount of 1 to 5 parts by weight, and the water may be supplied in an amount of 50 to 100 parts by weight. For example, when the desulfurization catalyst is added in an amount of less than 1 part by weight, since the amount of the desulfurization catalyst is small, the desulfurization effect is insufficient. When the desulfurization catalyst is added in an amount of more than 5 parts by weight, the amount of catalyst introduced into the coal is excessively large, resulting in deterioration in the combustion efficiency of coal.

Hereinafter, other components and functions of the pretreatment apparatus 200 of the pretreatment desulfurization system according to the present disclosure will be described.

The pretreatment apparatus 200 of the pretreatment desulfurization system according to the present disclosure is an apparatus for preprocessing coal. The apparatus 200 facilitates mixing coal and a catalyst mixture so that the coal can be evenly impregnated with the catalyst mixture.

FIGS. 2 and 4 are perspective views illustrating one embodiment of the pretreatment apparatus of the pretreatment desulfurization system, and FIG. 5 is a perspective view illustrating another embodiment of the pretreatment apparatus of FIG. 4.

Referring to FIG. 2, the pretreatment apparatus 200 according to the present disclosure includes: a pretreatment conveyor 210 loaded with coal by a first chute 110; a frame 211 installed on an upper portion of a running line of the pretreatment conveyor 210; a first spray nozzle 212 supported on the frame 211, installed above a front end portion of the pretreatment conveyor 210, and configured to spray a catalyst mixture onto the pretreatment conveyor 210 before the coal is loaded and to spray the catalyst mixture onto the top of the coal being transported on the pretreatment conveyor 210; a first hook 213 and a first hook spray nozzle 214 that are installed on the pretreatment conveyer to serve as a unit for spraying the catalyst mixture while scraping a side surface of the coal being transported on the conveyor, in which the first hook 213 is spaced apart from the first spray nozzle 212, supported on the frame 211, and disposed adjacent to one side of a surface of the pretreatment conveyor 210, and the first hook spray nozzle 214 is disposed on a side surface of the first hook 213; a second hook 215 and a second hook spray nozzle 216 installed to face the first hook 213 and the first hook spray nozzle 214; and a second spray nozzle 217 supported on the frame 211, installed above a rear end portion of the pretreatment conveyor 210, and configured to spray the catalyst mixture onto the top of the coal being transported on the pretreatment conveyor 210.

The process of pretreating coal using the pretreatment apparatus illustrated in FIG. 2 is illustrated in (a) to (d) of FIG. 3.

When coal is loaded onto the pretreatment conveyor 210 from the first chute 110, a pile of coal with an angle like a sand pile. Therefore, it is difficult to immerse an inside portion of the pile of coal.

For this reason, the pretreatment apparatus 200 according to the present disclosure sprays the catalyst mixture W onto the surface of the pretreatment conveyor 210 through the first spray nozzle 212 before the coal is loaded onto the pretreatment conveyor 210. Next, the pretreatment apparatus 200 loads coal on the pretreatment conveyer 210 using the first chute 110 (see (a) in FIG. 3) and sprays the catalyst mixture W onto the loaded coal through the first spray nozzle 212 so that the coal can be immersed in the catalyst mixture (see (b) in FIG. 3).

However, since the coal is loaded to form a pile of coal on the pretreatment conveyer 210, when the catalyst mixture is sprayed onto the pretreatment conveyor 210, it is difficult for the catalyst mixture to infiltrate deep into the pile of coal. For this reason, to evenly immerse the entire pile of coal with the catalyst mixture, the first hook and the second hook arranged to face each other and installed to be in contact with the surface of the pretreatment conveyor 210 makes a gap between the surface of the pretreatment conveyor and the pile of coal while scraping both sides of the pile of coal being transported on the pretreatment conveyor 210 in a running direction (see (c) in FIG. 3), and the catalyst mixture is sprayed toward the surface of the pretreatment conveyor 210 through the gap from the first hook spray nozzle 214 and the second hook spray nozzle 215. Therefore, the catalyst mixture can be supplied to the surface of the pretreatment conveyer 210, and thus the catalyst mixture can reach a deeper portion of the pile of coal (see (d) in FIG. 3).

In addition, the catalyst mixture is sprayed onto the upper surface of the pile of coal being transported on the pretreatment conveyor 210 from the second spray nozzle 217 disposed above a rear end portion of the pretreatment conveyor 210, so that the pile of coal can be entirely immersed in the catalyst mixture.

The "coal immersed in the catalyst mixture" (hereinafter, referred to as "catalyst-immersed coal") and having passed through the pretreatment apparatus 200 is transferred to the mesh conveyor 300 and separated into a liquid phase and a catalyst-treated coal. The separated catalyst-treated coal is then stored in the storage tank 400 until it is used for combustion.

The first and second hooks may be installed in a size and height adjustable manner according to the amount of coal and may be arranged at different heights.

The first hook and the second hook each may be present in a number of two or more, and the two or more first and second hooks may be arranged at regular intervals.

The pretreatment conveyor 210 has a U-shaped cross section so that the catalyst mixture can be retained as a puddle on the pretreatment conveyer and thus the coal can be immersed in the catalyst mixture.

Referring to FIG. 4, the pretreatment apparatus 200 according to the present disclosure includes: a screw conveyor 220 being supplied with coal and the catalyst mixture and causing the coal to be immersed in the catalyst mixture; and a third spray nozzle 222 and a fourth spray nozzle 223, each connected to an upper portion of the screw conveyor 220 to supply the catalyst mixture.

The pretreatment apparatus 200 may immerse coal in a catalyst mixture in a manner that coal is supplied from the first chute 110 to the screw conveyor 220, a catalyst and water are supplied to the screw conveyer respectively through the third spray nozzle and the fourth spray nozzle or vice versa, and the coal and the catalyst mixture are mixed in the screw conveyer 220.

The coal immersed in the catalyst mixture is transferred to the mesh conveyer 300 by way of the second chute 224 and is then separated into a liquid phase and a catalyst-treated coal, and the separated catalyst-treated coal is then stored in the storage tank 400 until it is used for combustion.

The pretreatment apparatus 200 may further include a driving unit 221 for rotating the screw of the screw conveyor 220.

A pretreatment apparatus 200 illustrated in FIG. 5 is the same as the pretreatment apparatus 200 illustrated in FIG. 4 except that the screw conveyer 220 has an angle with respect to the horizontal direction.

The pretreatment desulfurization system needs to be designed to fit the area or height of a given space. The pretreatment apparatus 200 illustrated in FIG. 5 is constructed such that the angle of the screw conveyer is adjustable to flexibly deal with the space constraints.

As in the pretreatment apparatus 200 illustrated in FIG. 4, this pretreatment apparatus 200 may immerse the supplied coal in the catalyst mixture in a manner that the coal is supplied from the first chute 110 to the screw conveyor 220, a catalyst and water are supplied to the screw conveyer respectively through the third spray nozzle and the fourth spray nozzle or vice versa, and the coal and the catalyst mixture are mixed in the screw conveyer 220.

The coal immersed in the catalyst mixture is transferred to the mesh conveyer 300 through the second chute 224 and is then separated into a liquid phase and a catalyst-treated coal, and the separated catalyst-treated coal is then stored in the storage tank 400 until it is used for combustion.

The pretreatment apparatus 200 may further include a conveyor discharging port 225 provided at a lower end of a first-side end of the screw conveyor 220 on the side opposite to the second chute 225, so that the liquid phase can be discharged through the conveyer discharging port 225.

Since the screw conveyor 220 is inclined, a liquid material may remain in the screw conveyor 220 on the opposite side of the second chute 224. Therefore, the liquid material remaining in the screw conveyor 220 will be discharged through the conveyor discharging port 225 after the catalyst-immersed coal is transferred to the mesh conveyor 300 through the second chute 224.

To this end, the recovery tank 310 is disposed under or below the conveyor discharging port 225, and a drainage channel 311 is installed under or below the mesh conveyor 300. The liquid phase discharged from the mesh conveyor 300 is transferred along the drainage channel 311 and is then collected in the recovery tank 310.

The pretreatment desulfurization catalyst used in the present disclosure is a catalyst capable of removing sulfur oxides. The pretreatment desulfurization catalyst includes at least one oxide selected from the group consisting of $SiO_2$, $Al_2O_3$, $Fe_2O_3$, $TiO_2$, MgO, MnO, CaO, $Na_2O$, $K_2O$, and $P_2O_3$. Preferably, the pretreatment desulfurization agent includes all of the oxides selected from the group consisting of $SiO_2$, $Al_2O_3$, $Fe_2O_3$, $TiO_2$, MgO, MnO, CaO, $Na_2O$, $K_2O$, and $P_2O_3$ as in one example described below.

When all of $SiO_2$, $Al_2O_3$, $Fe_2O_3$, $TiO_2$, MgO, MnO, CaO, $Na_2O$, $K_2O$, and $P_2O_3$ are included in a material, the basic formula thereof is represented as $K_{0.8\text{-}0.9}(Al,Fe,Mg)_2(Si,Al)_4O_{10}(OH)_2$ which is a mineral called illite. The illite has a 2:1 structure in which one octahedral layer is bonded between two tetrahedral layers. The octahedral layer has a dioctahedral structure in which only 2 cation sites out of 3 cation sites in the bonding structure are filled with cations. Due to the cation deficiency, the illite is overall negatively charged (−). For this reason, sulfur oxides ($SO_x$) can be adsorbed when the mixture of a combustible material and the desulfurization catalyst is burned.

As the oxides, the desulfurization catalyst may include 15 to 90 parts by weight of $SiO_2$, 15 to 100 parts by weight of $Al_2O_3$, 10 to 50 parts by weight of $Fe_2O_3$, 5 to 15 parts by weight of $TiO_2$, 20 to 150 parts by weight of MgO, 10 to 20 parts by weight of MnO, and 20 to 200 parts by weight of CaO, 15 to 45 parts by weight of $Na_2O$, 20 to 50 parts by weight of $K_2O$, and 5 to 20 parts by weight of $P_2O_3$.

In addition, the oxides may be mixed and pulverized into fine particles having a particle size of 1 to 2 μm by a pulverizer before being prepared as the desulfurization catalyst. The oxides may have a specific gravity of 2.5 to 3.0 and may be used in the form of a streak-colored or silvery white powder.

The desulfurization catalyst used in the present disclosure may include one or more metals selected from the group consisting of Li, Cr, Co, Ni, Cu, Zn, Ga, Sr, Cd, and Pb. As in one example, all of the metals including Li, Cr, Co, Ni, Cu, Zn, Ga, Sr, Cd, and Pb are preferably included.

As the metals, the desulfurization catalyst may include 0.0035 to 0.009 parts by weight of Li, 0.005 to 0.01 parts by weight of Cr, 0.001 to 0.005 parts by weight of Co, 0.006 to 0.015 parts by weight of Ni, 0.018 to 0.03 parts by weight of Cu, 0.035 to 0.05 parts by weight of Zn, 0.04 to 0.08 parts by weight of Ga, 0.02 to 0.05 parts by weight of Sr, 0.002 to 0.01 parts by weight of Cd, and 0.003 to 0.005 parts by weight of Pb.

Like the oxides, the metals may be pulverized into fine particles having a particle size of 1 to 2 μm by a pulverizer. The metals may have a specific gravity of 2.5 to 3.0 and may be used in the form of a streak-colored and silvery white powder.

The desulfurization catalyst used in the present disclosure may include at least one liquid composition selected from the group consisting of sodium tetraborate ($Na_2B_4O_7 \cdot 10H_2O$), sodium hydroxide (NaOH), sodium silicate ($Na_2SiO_3$), and hydrogen peroxide ($H_2O_2$). Preferably, as in one example, all of the liquid compositions including sodium tetraborate, sodium hydroxide, sodium silicate, and hydrogen peroxide may be included.

In the desulfurization catalyst according to the present disclosure, the oxide(s) and the liquid composition(s) serve as chelating agents during mixing and reaction, thereby forming a metal chelate compound through coordination with the metals.

In addition, the liquid composition may be adsorbed on ash generated when a combustible material is burned so that the liquid composition may react with sulfur oxides present in the ash, thereby removing the sulfur oxides. $NaBO_2$ is derived from sodium tetraborate ($Na_2B_4O_7$), $NaBH_4$ is produced through hydrogenation, and the produced $NaBH_4$ reacts with oxygen and sulfur oxides to form sodium sulfate ($Na_2SO_4$). Thus, the sulfur oxides are removed. The reactions can be expressed as Reaction Formulas 1 and 2 below.

[Reaction Formula 1]

$$NaBH_4+O_3 \rightarrow Na_2O_2+H_2O+B$$

[Reaction Formula 2]

$$Na_2O_2+SO_3 \rightarrow Na_2SO_4+O \quad 1)$$

$$Na_2O_2+SO_2 \rightarrow Na_2SO_4 \quad 2)$$

$$Na_2O_2+SO \rightarrow Na_2SO_3 \quad 3)$$

In addition, as the liquid compositions, the sodium tetraborate, the sodium hydroxide, the sodium silicate, and the hydrogen peroxide may be included in amounts of 20 to 130 parts by weight, 15 to 120 parts by weight, 50 to 250 parts by weight, and 10 to 50 parts by weight, respectively in the desulfurization catalyst.

In addition, after the mixing and reaction, the desulfurization catalyst may be allowed to stand for 24 to 72 hours for stabilization, and the desulfurization catalyst may be separated and used in the form of a liquid.

When the desulfurization catalyst used in the present disclosure is mixed with a combustible material C and combusted together at a temperature in the range of from 400° C. to 1200° C., the sulfur oxide adsorption effect may be activated. However, when the combustion is performed in a temperature range of 600° C. to 900° C., the sulfur oxide adsorption efficiency is higher.

The pretreatment desulfurization system 10 using a desulfurization catalyst, according to the present disclosure, can prevent emissions of sulfur oxides into the air during coal combustion, thereby contributing to solving the problems of air pollution caused by sulfur oxides.

In addition, unlike conventional flue gas desulfurization methods of performing desulfurization after the completion of fuel combustion, the pretreatment desulfurization system according to the present disclosure pretreats coal with a pretreatment desulfurization catalyst by immersing the coal in the pretreatment desulfurization catalyst before combustion, thereby obtaining a catalyst-treated coal, which is coal impregnated with the desulfurization catalyst. Since this catalyst-treated coal is combusted, the coal and the desulfurization catalyst are simultaneously burned. Therefore, the coal pretreatment desulfurization system according to the present disclosure can be implemented using an existing combustion system without building a new additional facility for desulfurization. That is, the coal pretreatment desulfurization system according to the present disclosure is simple and easy to apply and exhibits good desulfurization efficiency.

In addition, the pretreatment desulfurization system according to the present disclosure can recover the desulfurization catalyst from the waste liquid phase discharged after the pretreatment of coal. Since, the desulfurization catalyst is recycled, the pretreatment desulfurization system according to the present disclosure is economically and environmentally beneficial.

Hereinafter, the present disclosure will be described in more detail with reference to examples and the like, but the scope of the present disclosure is not limited by the examples described below.

EXAMPLE

In this example, the sulfur oxide content of a catalyst-treated coal produced by using a pretreatment desulfurization system according to the present disclosure was determined by comparison between the sulfur oxide content of raw coal that was not pretreated and the sulfur oxide content of coal that was treated with a catalyst.

Example 1: Verification of Effectiveness of Desulfurization Catalyst System on LOM Coal Preparation of Coal Samples Coals procured from Russia and supplied by LOM Co., Ltd. were used as coal samples to verify the effectiveness of desulfurization catalysts through experiments.

Two types of coal samples Coal 1 and Coal 2 that were obtained had a sulfur content of 3.51% and a sulfur content of 1.17%, respectively.

Preparation of Catalyst-Treated Coal

As desulfurization catalysts, Desulfurization Catalyst 1 (BP-106) and Desulfurization Catalyst 2 ($B_3C_5$) were used in an amount of 3 g for each. In addition, 100 g of water were used.

100 g of each of the coal samples Coal 1 and Coal 2 was immersed in each catalyst mixture for 20 minutes, in which each of the catalyst mixtures included 3 g of an interest desulfurization catalyst and 100 g of water. Next, the immersed coal samples were naturally dehydrated for 30 minutes. After the natural dehydration, the coal samples weighed in the range of from 125 g to 135 g, indicating that the amount of the catalyst mixture relative to the weight of the used coal was about 30 parts by weight.

Each of the naturally dehydrated catalyst-treated coal samples was dried in an 80° C. dryer for 8 hours to produce Pretreated Coal 1 (which is Coal 1 pretreated with BP-106), Pretreated Coal 2 (which is Coal 1 pretreated with $B_3C_5$), Pretreated Coal 3 (which is Coal 2 pretreated with BP-106), and Pretreated Coal 4 (which is Coal 2 pretreated with $B_3C_5$).

Measurement of Sulfur Content and Results Thereof

Experiments were performed using a sulfur analyzer to measure the sulfur content of each of the prepared catalyst-treated coal samples.

The operating conditions of the sulfur analyzer were set to be the same as the temperature conditions of a combustion chamber. That is, the sulfur content (SOx) of each of Coal 1, Coal 2, and Pretreated Coals 1 to 4 was measured at 1,050° C.

The mean value of the total sulfur content of each of Coal 1, Pretreated Coal 1, and Pretreated Coal 2 is shown in FIG. 6, and the mean value of the total sulfur content of each of Coal 2, Pretreated Coal 3, and Pretreated Coal 4 is shown in FIG. 7.

As illustrated in FIG. 6, the mean value of the total SOx was 3.51% for Coal 1, and the mean values of the total SOx were about 1.6% and about 2.0% respectively for Pretreated Coal 1 and Pretreated Coal 2, which were obtained by pretreating Coal 1 with respective desulfurization catalysts described above. This means that both of the pretreated coal samples exhibited a reduction in total SOx.

In addition, as illustrated in FIG. 7, the mean value of the total SOx was 1.77% for Coal 2, and the mean values of the total SOx were about 0.70% and about 1.11%, respectively for Pretreated Coal 3 and Pretreated Coal 4, which were obtained by pretreating Coal 2 with the two desulfurization catalysts, respectively.

Example 2: Verification of Effectiveness of Desulfurization Catalyst System on POSCO Anthracite and Coke Preparation of Coal Samples Anthracite and coke supplied from POSCO were used as coal samples to test the effectiveness of desulfurization catalysts.

Preparation of Catalyst-Treated Coal

As a desulfurization catalyst, the desulfurization catalyst BP-106 used in Example 1 was used. The desulfurization catalyst was mixed with water in varying ratios of 0:1, 1:1, 2:1, 5:1, and 10:1 to prepare catalyst mixtures.

100 g of each of anthracite and coke was immersed in 100 g of each catalyst mixture for 20 minutes and then naturally dehydrated for 30 minutes. The total weight of each of the coal samples weighed as shown in Tables 1 and 2 below after the natural dehydration.

The naturally dehydrated catalyst-treated coal samples were dried in an 80° C. dryer for 8 hours, and thus the pretreated coal samples were prepared.

Measurement of Sulfur Content and Results Thereof

Experiments were performed using a sulfur analyzer to measure the sulfur content of each of the prepared catalyst-treated coal samples.

The operating conditions of the sulfur analyzer were set to be the same as the temperature conditions of a combustion chamber. That is, the sulfur content (SOx) of each of anthracite, coke, and Pretreated Coals 5 to 14 was measured at 1,050° C. Measurements were repeated 10 or 11 times per sample to obtain the mean value.

The mean value of the total sulfur content of each of the anthracite and Pretreated Coals 5 to 9 that were obtained by pretreating the anthracite is shown in Table 1 below, and the mean value of the total sulfur content of each of the coke and Pretreated Coals 10 to 14 that were obtained by pretreating the coke is shown in Table 2 below.

TABLE 1

| | | Posco raw coal | Pretreated Coal 5 Water:Catalyst = 0:1 | Pretreated Coal 6 Water:Catalyst = 1:1 | Pretreated Coal 7 Water:Catalyst = 2:1 | Pretreated Coal 8 Water:Catalyst = 5:1 | Pretreated Coal 9 Water:Catalyst = 10:1 |
|---|---|---|---|---|---|---|---|
| Weight after dehydration | | | 131 g | 127 g | 120 g | 121 g | 127 g |
| Content | 1 | 0.59 | 0 | 0.26 | 0.17 | 0.23 | 0.26 |
| | 2 | 0.38 | 0.01 | 0.26 | 0.18 | 0.19 | 0.25 |
| | 3 | 0.25 | 0 | 0.14 | 0.15 | 0.2 | 0.25 |
| | 4 | 0.39 | 0 | 0.36 | 0.14 | 0.21 | 0.34 |
| | 5 | 0.47 | 0.03 | 0.25 | 0.13 | 0.2 | 0.32 |
| | 6 | 0.29 | 0.02 | 0.15 | 0.13 | 0.37 | 0.26 |
| | 7 | 0.25 | 0.03 | 0.15 | 0.18 | 0.23 | 0.37 |
| | 8 | 0.3 | 0.04 | 0.14 | 0.17 | 0.23 | 0.2 |
| | 9 | 0.52 | 0.02 | 0.2 | 0.18 | 0.24 | 0.21 |
| | 10 | 0.33 | 0.02 | 0.22 | 0.17 | 0.26 | 0.22 |
| | Average | 0.377 | 0.017 | 0.213 | 0.16 | 0.236 | 0.268 |
| Reduction rate | | | 95.49% | 43.5% | 57.56% | 37.4% | 28.91% |

TABLE 2

| | | POSCO coke | Pretreated Coal 10 Water:Catalyst = 0:1 | Pretreated Coal 11 Water:Catalyst = 1:1 | Pretreated Coal 12 Water:Catalyst = 2:1 | Pretreated Coal 13 Water:Catalyst = 5:1 | Pretreated Coal 14 Water:Catalyst = 10:1 |
|---|---|---|---|---|---|---|---|
| Weight after dehydration | | | 141 g | 145 g | 153 g | 143 g | 132 g |
| Content | 1 | 0.84 | 0.33 | 0.38 | 0.51 | 0.45 | 0.58 |
| | 2 | 0.84 | 0.26 | 0.39 | 0.43 | 0.42 | 0.49 |
| | 3 | 0.85 | 0.15 | 0.4 | 0.43 | 0.48 | 0.49 |
| | 4 | 0.86 | 0.24 | 0.42 | 0.44 | 0.49 | 0.54 |
| | 5 | 0.86 | 0.2 | 0.43 | 0.43 | 0.49 | 0.53 |
| | 6 | 0.85 | 0.21 | 0.44 | 0.42 | 0.54 | 0.51 |
| | 7 | 0.85 | 0.22 | 0.42 | 0.4 | 0.54 | 0.53 |
| | 8 | 0.86 | 0.35 | 0.42 | 0.38 | 0.49 | 0.51 |
| | 9 | 0.87 | 0.22 | 0.45 | 0.47 | 0.48 | 0.52 |
| | 10 | 0.85 | 0.3 | 0.44 | 0.48 | 0.49 | 0.5 |
| | 11 | 0.84 | 0.33 | 0.38 | 0.51 | 0.45 | 0.58 |
| | Average | 0.853 | 0.248 | 0.419 | 0.439 | 0.487 | 0.52 |
| Reduction rate | | | 70.93% | 50.88% | 48.53% | 42.71% | 39.04% |

As shown in Table 1, it was confirmed that the mean value of the total SOx was 0.377% for the anthracite. Pretreated Coals 5 to 9 obtained by pretreating the anthracite with each of the catalyst mixtures all exhibited a reduction in the SOx. It was confirmed that SOx was reduced by up to 95%.

In addition, as shown in Table 2, the mean value of the total SOx of the coke was 0.853%. Each of Pretreated Coals 10 to 14 obtained by pretreating the coke with a corresponding one of the catalyst mixtures was found to reduce SOx, and the SOx reduction effect of up to 71% was obtained.

INDUSTRIAL APPLICABILITY

The present disclosure can be widely applied to pretreatment desulfurization systems.

The invention claimed is:

1. A pretreatment desulfurization system comprising:

a first chute configured to supply coal conveyed by a belt conveyor to a pretreatment apparatus;

wherein, the pretreatment apparatus configured to desulfurize the supplied coal by immersing the supplied coal in a catalyst mixture in which a desulfurization catalyst and water are mixed, to produce a catalyst-immersed coal;

a mesh conveyor configured to separate the catalyst-immersed coal having passed through the pretreatment apparatus into a liquid phase and a catalyst-treated coal; and a storage tank configured to store the separated catalyst-treated coal.

2. The pretreatment desulfurization system of claim 1, wherein the mesh conveyor is constructed such that the liquid phase in the catalyst-immersed coal passes through the mesh conveyor and falls, and only the catalyst-treated coal remains on the mesh conveyor.

3. The pretreatment desulfurization system of claim 1, wherein the mesh conveyor further comprises a recovery tank configured to collect, store, and re-supply the liquid phase separated through the mesh conveyor to the pretreatment apparatus.

4. The pretreatment desulfurization system of claim 1, wherein the pretreatment apparatus comprises:

a pretreatment conveyor loaded with coal by a first chute;

a frame installed above a running line of the pretreatment conveyor;

a first spray nozzle supported on the frame, installed above a front end portion of the pretreatment conveyor, and configured to spray the catalyst mixture onto the pretreatment conveyor before the coal is loaded and to spray the catalyst mixture onto an upper surface of the coal loaded on the pretreatment conveyor;

a first hook and a first hook spray nozzle that are installed on the pretreatment conveyor to serve as a unit for spraying the catalyst mixture while scraping a side surface of the coal being conveyed by the pretreatment conveyor, wherein the first hook is installed on the frame, spaced apart from the first spray nozzle, and disposed adjacent to one side of a surface of the pretreatment conveyor, and the first hook spray nozzle is disposed on a side surface of the first hook;

a second hook and a second hook spray nozzle installed to face the first hook and the first hook spray nozzle, respectively; and a second spray nozzle supported on the frame, installed above the rear end portion of the pretreatment conveyor, and configured to spray the catalyst mixture onto an upper surface of the coal being transported on the pretreatment conveyor.

5. The pretreatment desulfurization system of claim 4, wherein the pretreatment conveyor has a U-shaped cross section so that the catalyst mixture forms a puddle on the pretreatment conveyer so that the coal is immersible.

6. The pretreatment desulfurization system of claim 1, wherein the pretreatment apparatus comprises:

a screw conveyor supplied with the coal and the catalyst mixture and configured to immerse the coal in the catalyst mixture; and a third spray nozzle and a fourth spray nozzle connected to an upper portion of the screw conveyor to supply the catalyst mixture.

7. The pretreatment desulfurization system of claim 1, wherein in the catalyst mixture, the desulfurization catalyst and the water are mixed in a mixing ratio in a range of 1:1 to 1:20.

8. The pretreatment desulfurization system of claim 1, wherein for 100 parts by weight of the coal, the desulfurization catalyst is supplied in an amount of 1 to 5 parts by weight and the water is supplied in an amount of 50 to 100 parts by weight.

9. The pretreatment desulfurization system of claim 1, wherein the desulfurization catalyst comprises:

(a) an oxide selected from the group consisting of $SiO_2$, $Al_2O_3$, $Fe_2O_3$, $TiO_2$, MgO, MnO, CaO, $Na_2O$, $K_2O$, $P_2O_3$, and a mixture thereof;

(b) a metal selected from the group consisting of Li, Cr, Co, Ni, Cu, Zn, Ga, Sr, Cd Pb, a mixture thereof; and (c) a liquid composition selected from the group consisting of sodium tetraborate ($Na_2B_4O_7 \cdot 10H_2O$), sodium hydroxide (NaOH), sodium silicate ($Na_2SiO_3$), hydrogen peroxide ($H_2O_2$), and a mixture thereof.

10. The pretreatment desulfurization system of claim 9, wherein the oxide comprises 15 to 90 parts by weight of $SiO_2$, 15 to 100 parts by weight of $Al_2O_3$, 10 to 50 parts by weight of $Fe_2O_3$, 5 to 15 parts by weight of $TiO_2$, 20 to 150 parts by weight of MgO, 10 to 20 parts by weight of MnO, 20 to 200 parts by weight of CaO, 15 to 45 parts by weight of $Na_2O$, 20 to 50 parts by weight of $K_2O$, 5 to 20 parts by weight of $P_2O_3$, or a mixture thereof; and the metal comprises 0.0035 to 0.009 parts by weight of Li, 0.005 to 0.01 parts by weight of Cr, 0.001 to 0.005 parts by weight of Co, 0.006 to 0.015 parts by weight of Ni, 0.018 to 0.03 parts by weight of Cu, 0.035 to 0.05 parts by weight of Zn, 0.04 to 0.08 parts by weight of Ga, 0.02 to 0.05 parts by weight of Sr, 0.002 to 0.01 parts by weight of Cd, 0.003 to 0.005 parts by weight of Pb or a mixture thereof.

11. The pretreatment desulfurization system of claim 9, wherein the oxide and the metal have a particle size of 1 to 2 μm and a specific gravity of 2.5 to 3.0.

12. The pretreatment desulfurization system of claim 9, wherein the liquid composition comprises sodium tetraborate ($Na_2B_4O_7 \cdot 10H_2O$) in an amount of 20 to 130 parts by weight, sodium hydroxide (NaOH) in an amount of 15 to 120 parts by weight, sodium silicate ($Na_2SiO_3$) in an amount of 50 to 250 parts by weight, hydrogen peroxide ($H_2O_2$) in an amount of 10 to 50 parts by weight or a mixture thereof.

13. The pretreatment desulfurization system of claim 9, wherein in the desulfurization catalyst, the oxide, the metal, and the liquid composition form a metal chelate compound.

* * * * *